US007941877B2

(12) United States Patent
Gardenier et al.

(10) Patent No.: US 7,941,877 B2
(45) Date of Patent: May 17, 2011

(54) SOUND SYSTEM AND A HEAD REST FOR A SPA AND A SPA HAVING A SOUND SYSTEM

(75) Inventors: W. John Gardenier, Albany, NY (US); Anthony Brennan, Clifton Park, NY (US)

(73) Assignee: Saratoga Spa and Bath Co., Inc., Latham, NY (US)

( * ) Notice: Subject to any disclaimer, the term of this patent is extended or adjusted under 35 U.S.C. 154(b) by 627 days.

(21) Appl. No.: 10/621,749

(22) Filed: Jul. 17, 2003

(65) Prior Publication Data

US 2004/0016051 A1 Jan. 29, 2004

Related U.S. Application Data

(60) Division of application No. 10/268,371, filed on Oct. 10, 2002, now Pat. No. 6,763,532, which is a continuation-in-part of application No. 09/834,260, filed on Apr. 12, 2001, now Pat. No. 6,467,103.

(51) Int. Cl.
*A47K 3/00* (2006.01)

(52) U.S. Cl. ..... 4/541.1; 4/575.1

(58) Field of Classification Search ..... 4/496, 575.1, 4/576, 541.1–541.5
See application file for complete search history.

(56) References Cited

U.S. PATENT DOCUMENTS

| | | | | |
|---|---|---|---|---|
| 1,604,753 A | | 10/1926 | Marr | |
| 2,905,259 A | | 9/1959 | Ashe | |
| 3,585,991 A | | 6/1971 | Balamuth | 128/66 |
| 4,130,120 A | | 12/1978 | Kohler, Jr. | 128/373 |
| 4,389,740 A | | 6/1983 | Henry | 4/575 |
| 4,575,882 A | * | 3/1986 | Diamond | 4/559 |
| 4,839,930 A | | 6/1989 | Watkins | 4/546 |
| 5,369,796 A | | 11/1994 | Kung | 455/344 |
| 5,524,062 A | | 6/1996 | Oh | 381/154 |

(Continued)

FOREIGN PATENT DOCUMENTS

DE 32 29 451 A1 2/1984

(Continued)

OTHER PUBLICATIONS

Brochure "The Luxury Spa Line", Saratoga Spa Company, pp. 1-6 (undated).

(Continued)

*Primary Examiner* — Charles Phillips
(74) *Attorney, Agent, or Firm* — Heslin Rothenberg Farley & Mesiti P.C.

(57) ABSTRACT

A sound system and a head rest for a spa and a spa having a sound system are disclosed. The sound system includes a head rest mountable to a spa and at least one electronic speaker. The head rest includes sound emitting perforations and is mounted to the spa whereby the uppermost rim of the spa remains at a substantially uniform elevation. The electronic speaker is mounted to transmit audible sound through the perforations in the head rest. The head rest may also include a light-transferring insert that is illuminated to provide an enhanced bathing experience. The head rest may also include a fluid flow device, for example, a nozzle for water. The sound system and head rest can be used to introduce audio to a tub, spa, pool, bath, or shower while imposing little or no impact upon the fabrication, storage, or shipping of the tub, spa, pool, bath, or shower.

13 Claims, 10 Drawing Sheets

U.S. PATENT DOCUMENTS

| | | | | |
|---|---|---|---|---|
| 5,687,246 | A | 11/1997 | Lancon | 381/188 |
| 5,715,546 | A * | 2/1998 | Kvalvik | 4/580 |
| 5,754,989 | A * | 5/1998 | Ludlow | 4/541.6 |
| 6,021,208 | A | 2/2000 | Kin-Lung | 381/338 |
| 6,467,103 | B1 | 10/2002 | Gardenier et al. | 4/541.1 |
| 2003/0070218 | A1 | 4/2003 | Gardenier et al. | 4/541.1 |

FOREIGN PATENT DOCUMENTS

| | | |
|---|---|---|
| JP | 5103731 | 4/1993 |

OTHER PUBLICATIONS

Brochure "Geyser Spas" Saratoga Spa Co., pp. 1-4 (2000).

Brochure "Adirondack Spas" Saratoga Spa & Bath Co., Inc., pp. 2. (undated).

Brochure "Creating an Impression", Saratoga Spa Company., 20 pages. (Jul. 1997).

* cited by examiner

SOUND SYSTEM AND A HEAD REST FOR A SPA AND A SPA HAVING A SOUND SYSTEM

CROSS REFERENCE TO RELATED APPLICATIONS

This application is a divisional application of application Ser. No. 10/268,371 filed on Oct. 10, 2002 now U.S. Pat. No. 6,763,532, which is a continuation-in-part application of U.S. application Ser. No. 09/834,260 filed on Apr. 12, 2001, now U.S. Pat. No. 6,467,103, the disclosures of which are hereby incorporated by reference herein in their entirety.

TECHNICAL FIELD

This invention relates, generally, to methods and systems for providing sound transmission systems, for example, for transmitting music, and for providing illumination systems for tubs, spas, pools, baths, or showers and, more particularly, to head rest assemblies for spas having integral audio components and lighting for improved user enjoyment.

BACKGROUND ART

Hot tubs typically provide a means for bathers to relax in a controlled environment of warmth and gentle water massage provided by numerous fluid flow ports or nozzles. Hot tubs, or spas, provide relaxation and if desired, therapy, for example, hydrotherapy, for treatment of various ailments. As is known, the bather typically reclines in the hot tub and pulsating jets of water impact various locations on the bather's body. Typically, relaxation is enhanced in such tubs or spas by providing head rests so that the bather can fully recline during relaxation or treatment. Furthermore, relaxation and treatment can be further enhanced by the use of other amenities which provide an environment more conducive to relaxation or treatment. For example, it is known to provide spas or tubs with video monitors, audio speakers, and mood-enhancing lighting to enhance relaxation and treatment.

However, when such electronic devices are used, it is undesirable to locate such electronic devices in the vicinity of the water in the tub or spa for the obvious potential for damage to the electronic devices from exposure to the water (and the corrosive chemicals the water can contain) or to the humid environment typically present about a tub. Typically, when electronic devices are introduced to spas or tubs the installation of these devices is undertaken with great care to minimize the exposure of the electric wiring and components to direct contact with water or to exposure to the humid air. For example, in some prior art applications, the audio components are mounted in an elevated position, as far above the surface of the water as possible, while still providing sound audible to the bather. In addition, the elevated position of such speakers places the speaker at the approximate elevation of the ear of the bather. Such a typical prior art spa having speakers mounted in housing extensions located above the main spa housing is shown in an undated brochure distributed by Catalina Spas of Perris, Calif. Similar undesirable housing extensions for mounting speakers are also shown in U.S. Pat. No. 4,575,882 and in published Japanese patent 5,103,731 A. However, as will made clear from the description of the present invention below, such elevated installation of speakers on housing extensions or housing projections negatively impact the manufacturing process and the shipping requirements of the spa.

Though elevated above the water level, audio speakers, for example, are still susceptible to water damage, for example, from children splashing or humidity. Typically, to minimize the potential for damaging speakers mounted in a hot tub, more moisture-tolerant speakers are used, for example, "marine"-type speakers. However, such water-tolerant speakers are more costly than conventional speakers.

The use of elevated speakers has several undesirable impacts upon the manufacturing process. First, by mounting speakers in an elevated position, for example, above the nominal height of the spa housing, special accommodation must be made to provide an elevated "extension" to the housing to mount the speaker. These extensions for speaker mounting are, of course, located at an elevation that is typically beyond the height of the spa housing required to accommodate the water level and the bather. Thus, these extensions for speaker mounting require that the spa housing be modified from that which is typically required in conventional spas. For example, conventional spa housings are typically, one-piece, plastic constructions, molded, for example, from a thermoplastic. In the prior art, in order to provide the extensions for speaker mounting, either the molds must be modified to include the speaker mounting extensions or the pre-molded housings must be modified to provide the required speaker mounting extensions. Either modification adds to the fabrication cost of the spa and is thus undesirable. Thus, a need exists in the art for providing audio components to spas without requiring undesirable housing modifications.

In addition, the prior art practice of mounting audio speakers on housing extensions is not amenable to incorporating speakers into existing spa housings. For example, existing spa housings without speakers typically do not have mounting structures and cannot accommodate such speakers, that is, not without a costly modification to the existing housing. Thus, a need also exists in the art for providing audio components to a spa which can be installed in existing spas, that is, can be retro-fit, with little or no modification to the existing spa housing.

Furthermore, when electronics or other components are incorporated into a spa housing at an elevated position, the resulting increased height of the tub impacts the shipping requirements of the spa. Hot tubs or spas are typically shipped stacked one on top of the other. Thus, any increase in height of the spa increases the volume that the spa occupies during shipping, that is, an increase in housing height limits the number of spas that can be shipped in a given cargo space. Thus, a need also exists in the art to provide audio components to spa housings that do not negatively affect the shipping requirements of the spas. These and other limitations of the prior art are addressed by the present invention.

As noted above, the bathing or treatment experience is also typically enhanced by means of lighting. For example, it is known in the art to include decorative lighting, for example, about the perimeter of the spa. Again, due to the potential for the water and humidity to damage electric wiring, lightning is typically provided by means that are water and humidity tolerant, for example, by means of fiber-optic cables. These fiber-optic cables are typically illuminated by a remote LED source. Typically, the individual fiber optic cables are routed to individual light emitters distributed about the spa. However, the routing of individual cables to distributed emitters not only is tedious to install, but the numerous fiber-optic cables are also susceptible to damage and failure during installation and maintenance. This type of fiber-optic lighting is also illustrated in the Catalina Spas brochure referred to above. Thus, a need also exists in the art for providing a means for introducing environment-enhancing lighting to a spa that overcomes the disadvantages of the prior art lighting. This need is also addressed by the present invention.

SUMMARY OF THE INVENTION

According to the present invention, shortcomings of the existing art are overcome and additional advantages are provided through the provision of improved systems for providing sound and illumination for a spa while overcoming the limitations of the prior art described above. More specifically, the present invention provides for a head rest for a spa having an integral means of providing sound, even stereo sound, to a bather reclined in a spa. In addition to or in conjunction with this invention, according to the present invention, a head rest is provided having enhanced means of illumination without the limitations of the prior art.

One aspect of the invention is a spa, comprising: a housing having a tub section for holding water; a cushioned head rest mounted to said housing, the cushioned head rest having an upper extremity defining a surface at a first elevation and the cushioned head rest adapted to support the head of an occupant of the spa; at least one speaker mounted at an elevation at or below the first elevation; and means for providing sound to the at least one speaker. The at least one speaker may be mounted in head rest or in the housing, for example, the one or more speakers may be mounted in the housing adjacent the head rest. The speaker may be an electronic speaker or a perforation in the head rest or housing to which sound is provided by means of a sound wave guide.

Another aspect of the invention is a spa having a sound transmission system, said spa adapted for ease of fabrication, transport, and storage, comprising: a housing having a tub section for holding water; a cushioned head rest mounted to said housing, the cushioned head rest having an upper extremity defining a surface at a first elevation and the head rest adapted to support the head of the occupant of the spa; at least one speaker mounted at an elevation below the first elevation; and means for providing sound to the at least one speaker.

A third aspect of the invention is a sound transmission system for a spa having a housing, the system comprising: a source of sound waves; at least one sound wave guide operatively connected to the source of sound waves for transmitting the sound waves to a location on the spa whereby the sound waves are audible to an occupant of the spa. The sound transmission system may further comprise a sound wave distributor having at least one inlet for sound waves operatively connected to the source of sound waves and at least one outlet operatively connected to the at least one sound wave guide. The sound transmission system may also include at least one head rest and wherein the wave guide is operatively connected to at least one perforation located in the head rest. Though the wave guides of this aspect of the invention may take various forms, one or more conduits may typically be provided to function as sound wave guides.

In another aspect of the invention a head rest assembly for a spa is provided. This head rest assembly comprises: a head rest adapted for supporting the head of a bather; at least one perforation in the head rest for transmitting sound; and at least one sound wave guide for transmitting sound from a remote sound source to the at least one perforation whereby the sound is audible to the bather. The head rest assembly typically includes a plurality of perforations for transmitting sound. These perforations are typically at least two sets of perforations positioned adjacent to the ears of the bather. Again, the at least one sound wave guide may be at least one conduit for transmitting sound; typically a plurality of conduits is used. The head rest assembly may also include at least one light-transferring insert and the light-transferring insert may be illuminated by a source of light in or adjacent to the head rest. The head rest assembly in this aspect of the invention may also include at least one fluid flow device having at least one fluid inlet and at least one fluid outlet.

Another aspect of the invention is a spa having a head rest assembly comprising: a head rest adapted for supporting the head of a bather; at least one perforation in the head rest for transmitting sound; at least one wave guide for transmitting sound from a remote sound source to the at least one perforation wherein the sound is audible to the bather. The at least one wave guide may be at least one conduit, typically a plurality of conduits. The at least one perforation in the head rest may be a plurality of perforations. The remote sound source may be at least one audio speaker. The head rest may further include at least one light-transferring insert and at least one light source for illuminating the light-transferring insert.

A further aspect of the invention is a method of providing sound to an occupant of a tub, spa, or shower, or other enclosure, the enclosure having a housing and at least one perforation in the housing. The method comprises: providing a source of sound waves; and transmitting the sound waves through one or more sound wave guides to the at least one perforation in the housing so that the sound waves are audible to the occupant of the tub, spa, shower, or other enclosure. The source of sound may include a sound wave distributor, wherein this aspect of the invention may further comprise distributing the sound waves to the one or more sound wave guides by means of the sound wave distributor. Again, the sound wave guides may typically be one or more conduits, or a plurality of conduits.

A further aspect of the present invention is a head rest assembly for a tub, spa, or shower, said head rest assembly comprising: a head rest adapted for supporting the head of a bather; at least one light-transferring insert in the head rest; and means for illuminating the light-transferring insert. The means for illuminating the insert may be one of: an incandescent means, fluorescent means, fiber-optics means, and light-emitting-diode means. The at least one light-transferring insert may also be a plurality of light-transferring inserts and the light-transferring insert may be composed of a silicon-based material.

A still further aspect of the present invention is a spa, comprising: a housing having a tub section for holding water; and at least one speaker mounted in the tub section; wherein the at least one speaker comprises a diaphragm and an audio transducer which transmits sound to the spa by means of the diaphragm. In one aspect of the invention, the audio transducer transmits sound to the spa by vibrating the diaphragm. In another aspect of the invention, the water in the tub section comprises a water level, and wherein the centerline of the at least one speaker is positioned below the water level, for example, the speaker is completely submerged below the water level. In another aspect of the invention, the speaker further comprises a conduit, for example, an externally-threaded conduit, to which the diaphragm is mounted and wherein the conduit is mounted to the tub section. The speaker may further include a threaded retaining ring which retains the externally-threaded conduit in the tub section.

Another aspect of the invention is an audio speaker for use in one of a tub, spa, pool, and shower, the audio speaker comprising: a diaphragm; and an audio transducer which vibrates the diaphragm in response to an electrical signal. In one aspect of the invention, the audio speaker further includes a housing upon which the diaphragm is mounted. In one aspect of the invention, the housing may be a circular conduit. In one aspect of the invention, the circular conduit may be an externally-threaded circular conduit, and the audio speaker may further include an internally-threaded ring mounted on the externally-threaded circular conduit.

Thus, the present invention advantageously provides methods and apparatus for providing sound and illumination to spas, hot tubs, showers, tubs, baths, pools, or any other type of enclosure occupied by a bather while avoiding the limitations of the prior art. In particular, the present invention provides sound and illumination systems to spas while minimizing the impact of these systems on the manufacturing, shipping, and maintenance of the spa, while enhancing the bathing experience of the user of the spa.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention will be readily understood from the following detailed description of preferred embodiments taken in conjunction with the accompanying drawings in which:

BEST MODE FOR CARRYING OUT THE INVENTION

Figure 1:
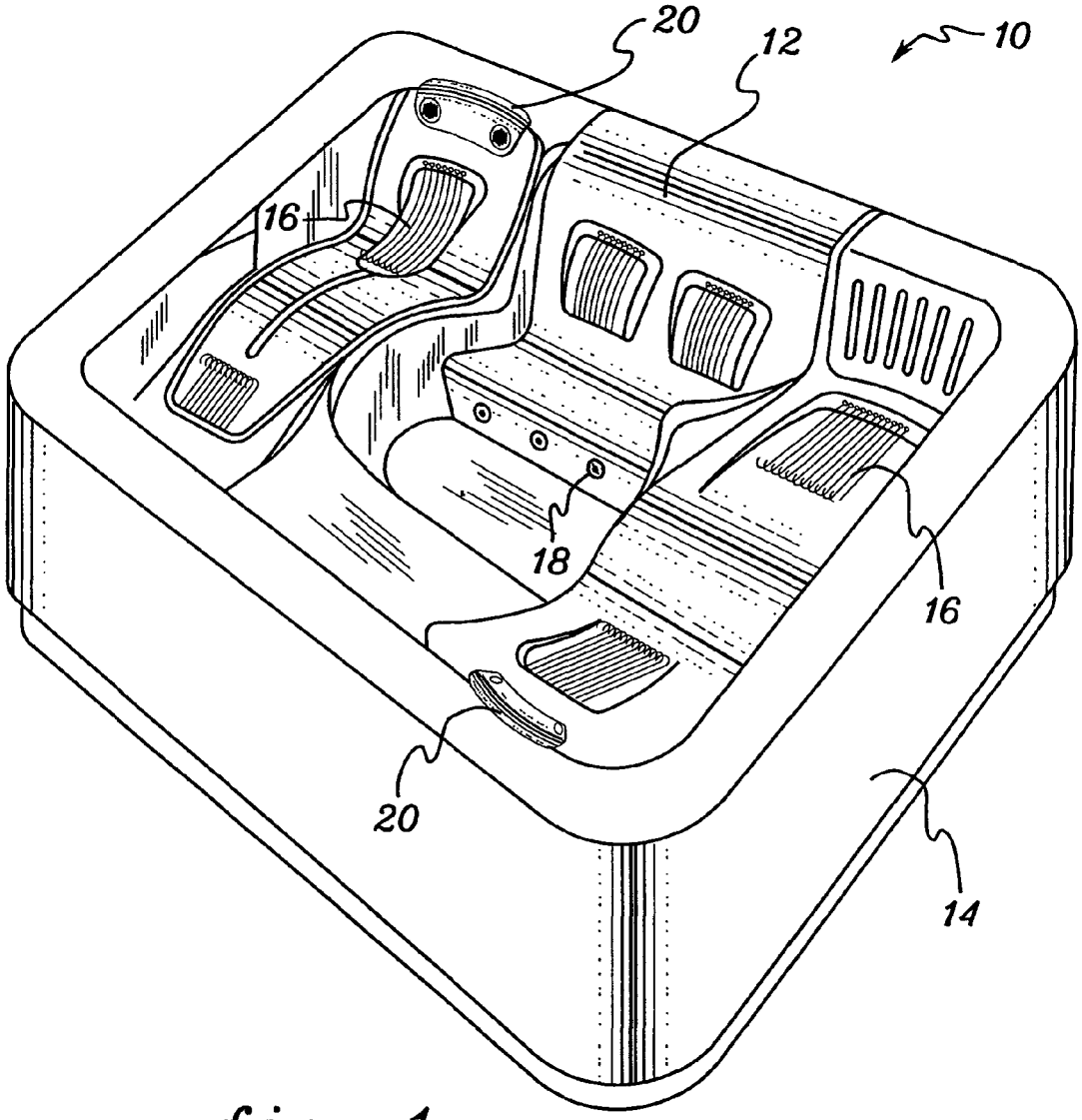
FIG. 1 is a perspective view of one example of a spa for which the present invention can be used.

FIG. 1 illustrates a spa 10 that incorporates one aspect of the present invention. Though the term "spa" will be used throughout this specification, it is to be understood that the present invention is applicable to spas, hot tubs, baths, showers, and pools, among other fluid bearing recreational or therapeutic devices. Furthermore, though the spa 10 shown in FIG. 1 is large enough to accommodate about four bathers, the present invention is applicable to any size spa, having any number of bathers or occupants, for example, spas having one or more bathers, or 4 our more bathers, or even 8 or more bathers.

As is conventional, spa 10 includes a tub portion or section 12 for holding water and a support structure 14 which supports tub section 12. In this specification, tub section 12 and support structure 14 comprise the housing of the spa. As is also conventional, the spa 10 provides accommodations 16, that is, seating, for one or more bathers; includes one or more water-jets 18; and one or more head rests 20. The spa 10 also typically includes various pumps, valves, piping, heaters, water conditioners, electronics and controls, and is provided with electrical power as is conventional and which are all not shown in FIG. 1.

Figure 2A:
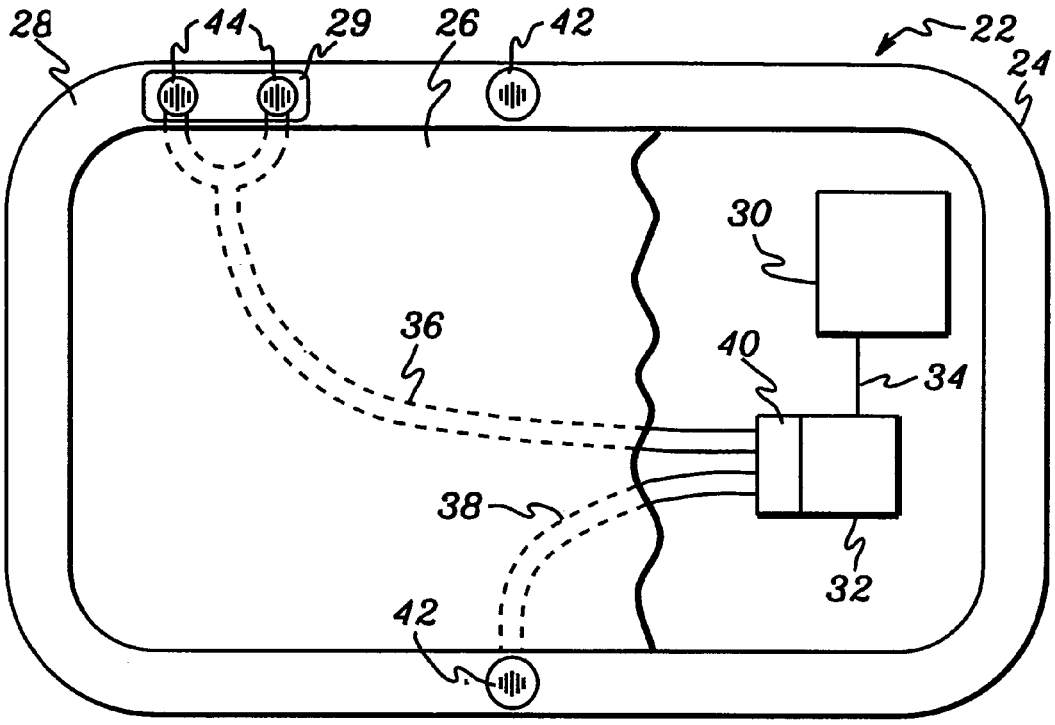
FIG. 2A is a schematic top view of a typical spa employing one aspect of the present invention.

FIG. 2A illustrates a top view of spa 22 which is similar to spa 10 shown in FIG. 1 but incorporating one embodiment of the present invention. Spa 22 includes a housing 24 which includes a tub portion 26, a support structure (not shown), a housing rim 28 about the top of tub portion 26, and at least one head rest 29. Head rest 29 is typically a flexible or cushioned head rest adapted to comfortably support the head of a bather. The seating for the one or more bathers and water jets are not shown in FIG. 2A to facilitate illustration. Also, part of the tub portion 26 is removed so that the audio components (30, 32) that can be used while practicing the present invention can be viewed. According to the present invention, the spa 22 includes at least one sound source 30 (with an appropriate power source not shown) and at least one audio speaker 32 which receives an audio signal from sound source 30 via wire or cable 34. The sound emitted by speaker 32 is distributed to one or more sound wave guides 36, 38 by means of a sound wave distributor 40. The sound introduced to the wave guides 36, 38 is transmitted by wave guides 36, 38 to one or more "speakers" 42, 44. In one aspect of the invention, speakers 42, 44 are not conventional electronic audio speakers, for example, electronic audio speaker 30. Speakers 42, 44 according one aspect of the present invention can simply be sound emitting orifices in the housing 24 through which the sound waves transmitted through wave guides 36, 38 can pass such that a sound audible to the occupant of spa 22 is produced. Speakers 42, 44 may also be electronic audio speakers, for example, marine-grade audio speakers which receive electrical signals via wires directly from, for example, audio component 30. Speaker 42 is positioned, for example, in the housing rim 28 of spa 22 and speakers 44 are positioned in head rest 29. Though speakers 44 are shown mounted in head rest 29 in FIG. 2A, according to the invention, speakers 44 may also be mounted adjacent to head rest 29, for example, to each side of head rest 29 or below head rest 29. A more detailed description of the speakers 42, 44 appears below and these speakers are illustrated in FIGS. 3A, 3B, 4A, and 4B.

Sound source 30 may be any conventional source of sound that can produce an electronic signal to audio speaker 32 to produce an audible sound, such as music (instrumental or vocal) or voice (such as voice instruction). The sound source 30 may be a radio, stereo, compact disc player, tape player, phonograph, television, video cassette recorder/player (VCR), digital video disc (DVD) player, computer, MP3 player, or any other electronic component capable of producing a sound signal for speaker 32. The sound source 30 may also be two or more of the devices listed or a combination thereof. Of course, the speaker 32 may be integral to sound source 30 and require no external wire or cable 34.

The speaker 32 is typically any type of conventional audio speaker, for example, a speaker having one or more vibrating membranes (for example, woofers, tweeters, sub-woofers, etc.) that can produce audible sound waves. However, other types of devices that produce audible sound waves may also used for the present invention. Though a single speaker 32 is shown in FIG. 2A, the present invention also includes having two or more speakers 32. For example, two or more stereo speakers 32 may receive left and right stereo signals from sound source 30 or from two or more sound sources 30.

Figure 2B:
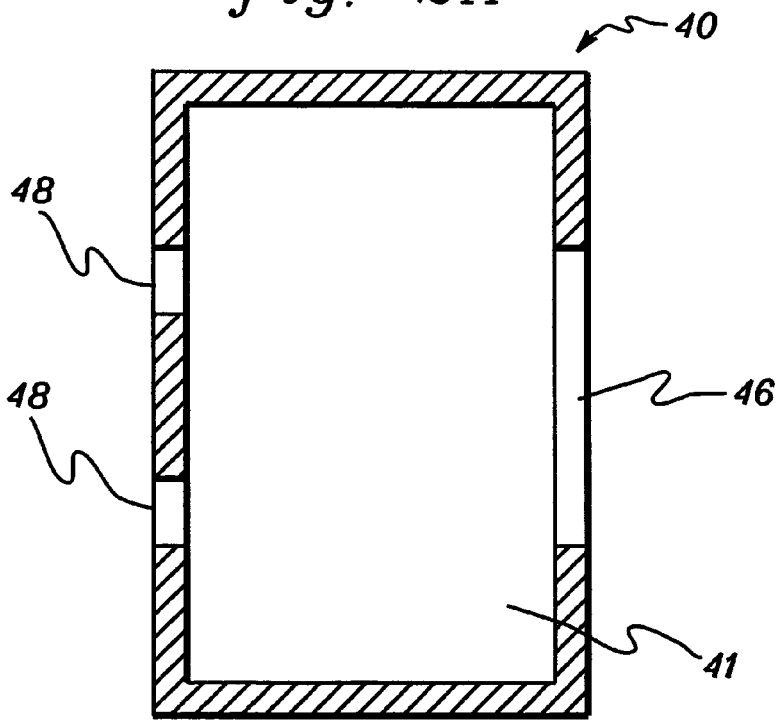
FIG. 2B is a cross section of a sound wave distributor that can be used when practicing the present invention.

Sound wave distributor 40 simply distributes the sound waves output by speaker 32 to one or more wave guides 36, 38. A cross-sectional view of one sound wave distributor that may be used when practicing the present invention is shown in FIG. 2B. As shown in FIG. 2B, sound wave distributor 40 may simply be an enclosed cavity or chamber 41 having an opening or inlet 46 for receiving sound waves from speaker 32 and one or more openings or outlets 48 for emitting sound waves. Sound wave distributor 40 may be integral with speaker 32 and may also, with speaker 32, be integral with sound source 30. Though a single inlet 46 is shown in FIG. 2B, one or more inlets 46 may be used according to the present invention. For example, the sound wave distributor 40 may receive sound waves from two or more speakers 32. Similarly, though two outlets 48 are shown in FIG. 2B, sound wave distributor 40 may have one or more sound wave outlets 48, for example, two or more sound wave outlets, or four or more sound wave outlets. The number and location of the outlets 48 in sound wave distributor 40 is dependent upon the size of the spa and the number of speakers 42, 44 desired.

Sound wave guides 36, 38 are typically conduits through which sound waves can pass, for example, flexible hoses. The conduits or sound wave guides 36, 38, may be any type of conduit that will transmit sound waves, such as piping, tubing, or hose, for example, vinyl hose or heater vent hose, among other types of conduit. Conduits 36, 38 may be individual conduits or conduits 36, 38 may be passages molded into the tub-portion 26 of spa 22. Conduits 36, 38 may also comprise voids in the housing 24 of spa 22, for example, unobstructed passages in the structure of the housing 24 through which sound may be transmitted. However, the conduits 36, 38 are preferably flexible tubing that can be routed within housing 24 of spa 22 from one or more audio speakers 32 to one or more speakers 42, 44. For example, one preferred type of tubing that can be used is flexible polyvinyl chloride (PVC) tubing provided by Plastiflex of Whippany, N.J. This type of conduit is typically provided with standard fasteners and connectors that facilitate routing and connecting the conduits 36, 38 to the speakers 42, 44 and distributor 40. Though preferably circular in cross-section, conduits 36, 38 may have any desirable cross-sectional shape, including square or rectangular. The conduits 36, 38 are typically between about 0.25 inches and about 6 inches in nominal diameter, and are preferably between about 0.50 inches and about 3 inches in nominal diameter, for example, about 1 inch in nominal diameter.

Figure 3A:
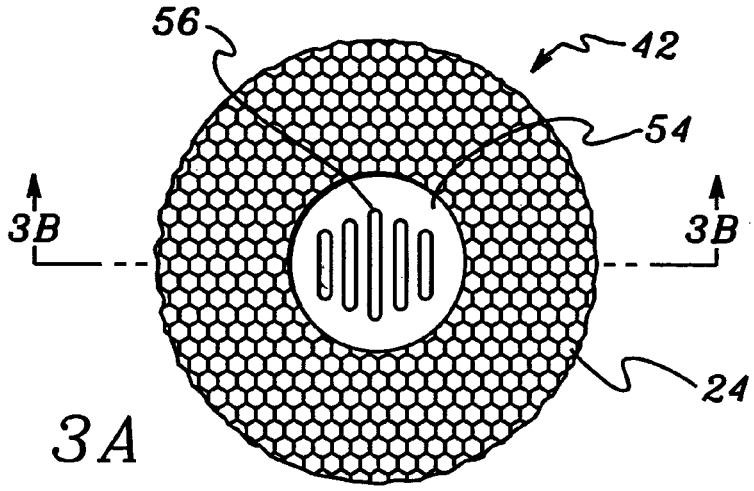
FIGS. 3A, and 3B illustrate a top view and a cross-sectional view, respectfully, of another aspect of the present invention.
Figure 3B:
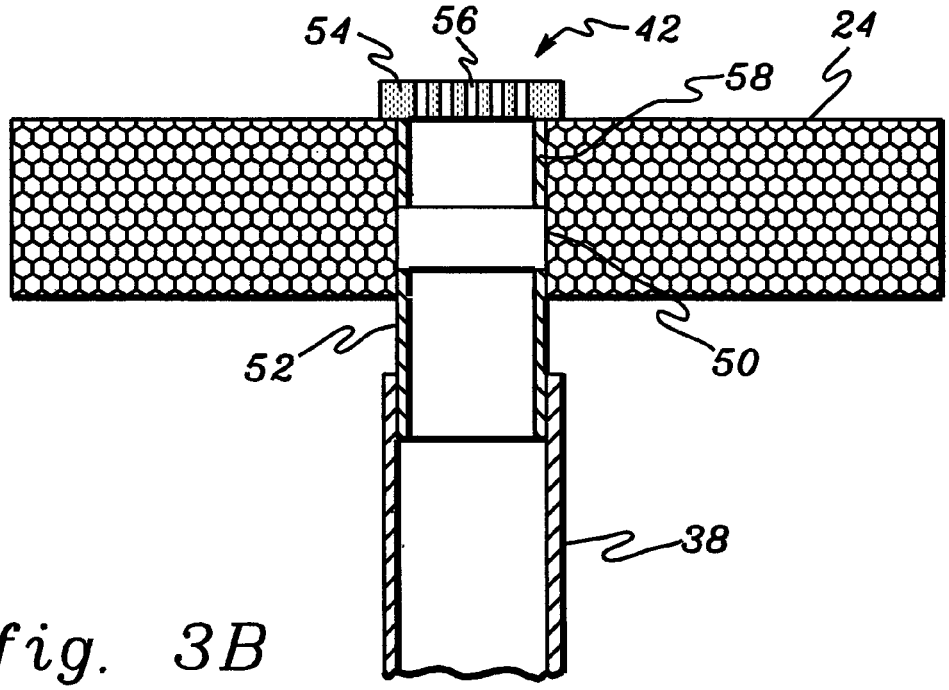
Figure 3C:
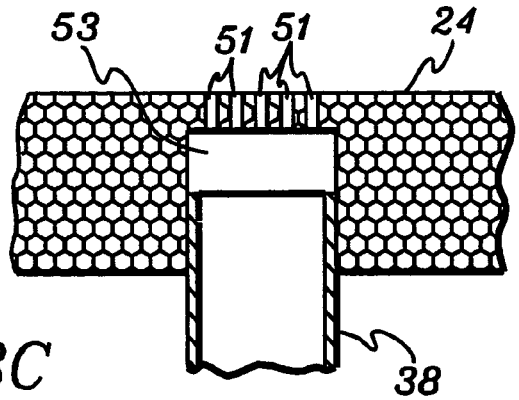
FIG. 3C illustrates an alternate means for practicing the present invention shown in FIGS. 3A and 3B.

A detail of speaker 42 is shown in FIGS. 3A, 3B, and 3C. FIG. 3A shows a top of view of speaker 42 mounted in the housing 24 according to one aspect of the present invention. FIG. 3B illustrates a side, cross-sectional view of speaker 42 as viewed along lines 3B-3B of FIG. 3A. Though speaker 42 may be an electronic speaker, in its simplest embodiment, "speaker" 42 is simply an orifice 50 in the housing 24 through which sound waves transmitted via conduit 38 may pass and be audible to the occupant of the spa 22. As shown in FIG. 3C, the orifice 50 may be a plurality of perforations 51, for example, a plurality of perforations in the housing 24 which communicate with a passage 53 in the housing 24 and conduit 38. The plurality of perforations may communicate directly with conduit 38 or via passage 53 as shown in FIG. 3C.

In FIG. 3B the conduit 38 is connected to and transmits sound waves to orifice 50 via connector 52. The connection between conduit 38 and connector 52 and connector 52 and housing orifice 50 may be a threaded connection, or a bolt-on flange connection. These connections may also be non-threaded connections, for example, connector 52 may include a series of parallel ridges on each end that produce an interference fit with flexible conduit 38 and housing orifice 50. However, conduit 38 may be connected directly to orifice 50 without an intermediate connector 52, or orifice 50 may consist of the end of conduit 38 mounted directly in housing 24.

According to a preferred embodiment, the orifice 50 is protected by perforated cover 54 having slotted perforations 56, though any shape perforations may be used. Cover 54 may also be mounted on a conduit 58 which engages the housing 24. Conduit 58 may be threaded or non-threaded, for example, conduit 58 may have parallel ridges as discussed above. Though shown circular in shape in FIG. 3A, perforated cover 54 may take any desirable shape, including square, rectangular, and oval, among others. Though not shown in FIG. 3A, cover 54 may also include a means for varying the size of the open area of the perforations 56 to effect a means of volume control, as shown in more detail in FIGS. 7A and 7B.

Figure 4A:
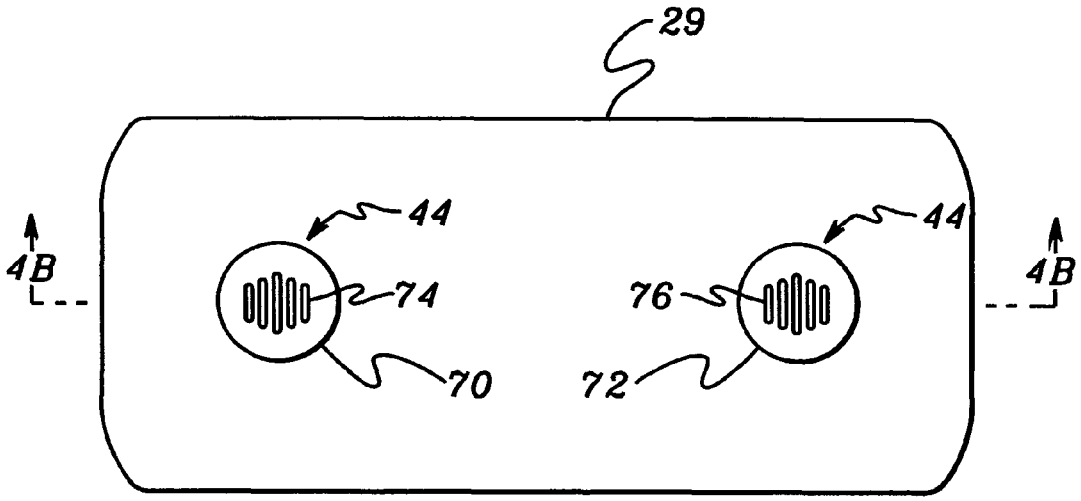
FIGS. 4A and 4B illustrate a top view and a cross-sectional view, respectfully, of a further aspect of the present invention.
Figure 4B:
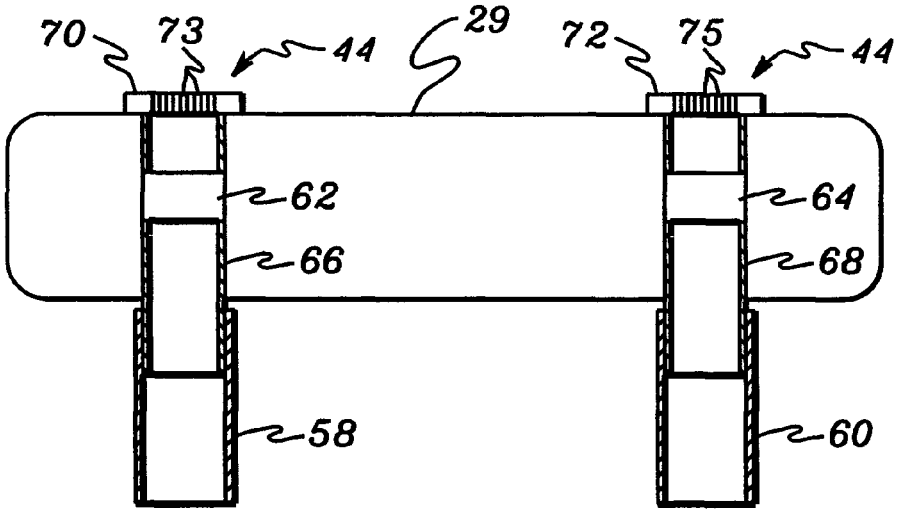

Another embodiment of the present invention is illustrated in FIGS. 4A and 4B. FIG. 4A illustrates a top view of speakers 44 mounted in the head rest 29 (see FIG. 2A) according to one aspect of the present invention. Again, speakers 44 may be conventional electronic speakers or simply perforations for transmitting sound. FIG. 4B illustrates a side, cross-sectional view as viewed along lines 4B-4B of FIG. 4A. As shown in FIG. 2A, conduit 36 may be bifurcated into two conduits, for example, conduits 58, 60 in FIG. 4B, for example, by means of a tee connection (not shown). Of course, a stereo effect can be provided by providing sound waves or electronic signals from one stereo component, for example, to one speaker, for example, via conduit 58, and signals or sound waves from a second stereo component can be provided to the other speaker, for example, via conduit 60.

Figure 8:
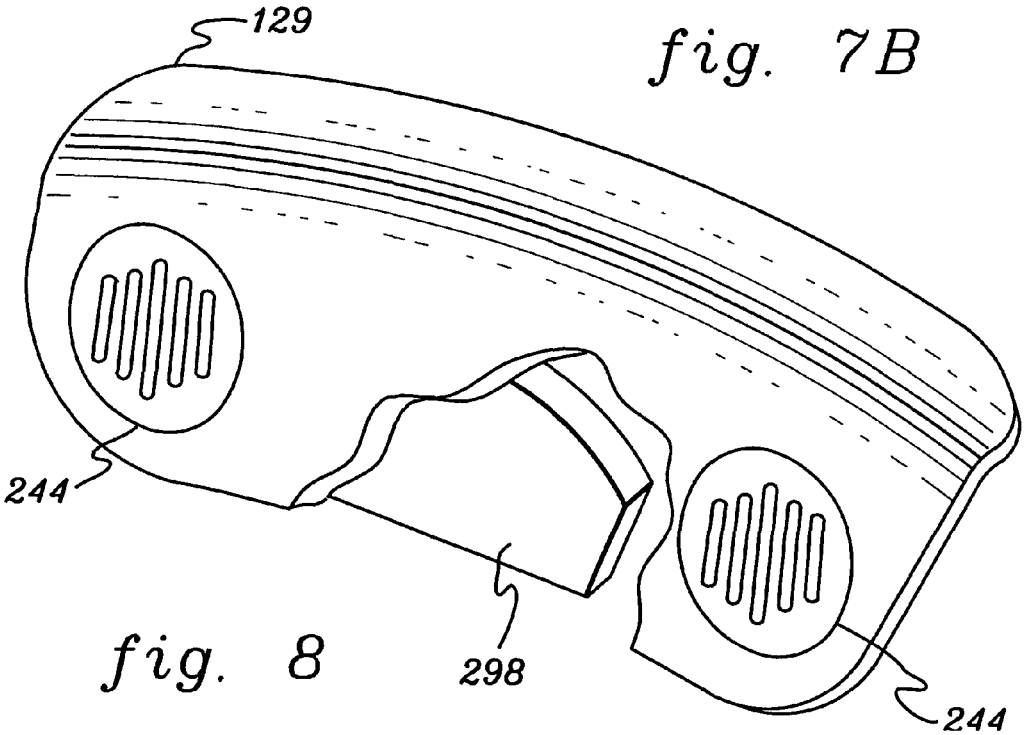
FIG. 8 is an isometric view of a head rest incorporating various aspects of the present invention.

Though shown in an idealized form as a simple rectangular shape for ease of illustration, head rest 29 typically is typically a cushioned head rest having a geometry that is contoured to accept the reclined head of an occupant of the spa, for example, as shown in FIG. 8. The head rest is typically fabricated from a resilient material, for example, polyurethane foam or polyethylene foam and is adapted for mounting onto the spa housing 24.

Figure 7A:
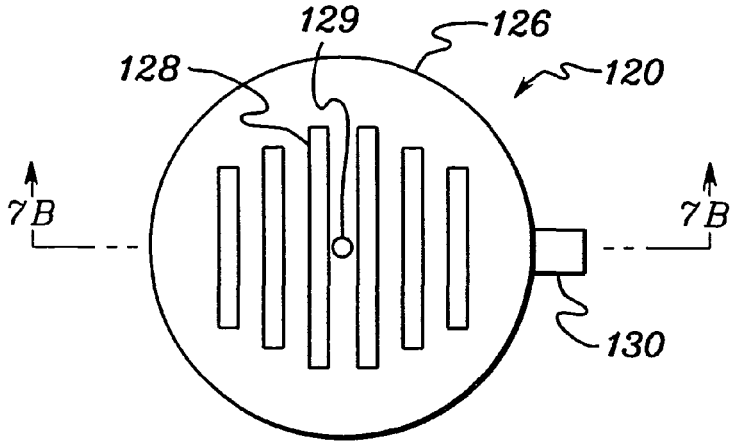
FIGS. 7A and 7B illustrate a top view and a cross-sectional view, respectfully, of a sound attenuation device that can be used with one or more aspects of the present invention.
Figure 7B:
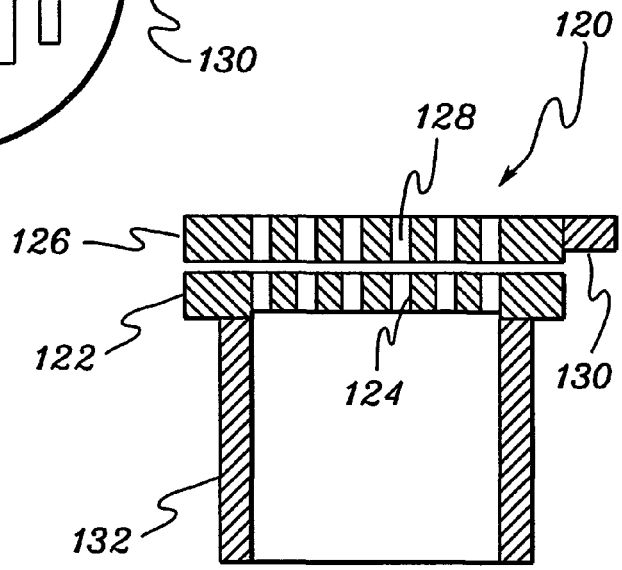

Similar to speaker 42 shown in FIG. 3A, though speakers 44 may be electronic speakers, in its simplest form, speakers 44 comprise simply orifices 62, 64 in head rest 29 through which sound waves transmitted via conduits 58, 60 pass and are audible to the occupant of the spa. In FIG. 4B the conduits 58, 60 are connected to and transmit sound waves to orifices 62, 64 via connectors 66, 68. Again, the connection between conduits 58, 60 and connectors 66, 68 and between connectors 66, 68 and head rest 29 may be threaded connections, but these connections may also be non-threaded connections, for example, connectors 66, 68 may include a series of parallel ridges on each end that produce an interference fit with flexible conduits 58, 60 and head rest 29. However, conduits 58, 60 may be connected directly to orifices 62, 64 or orifices 62, 64 may consist of the end of conduits 66, 68 mounted in head rest 29. Again, according to a preferred embodiment, the orifices 62, 64 are preferably protected by perforated covers 70, 72 having perforations 74, 76 as described with respect to orifice 54 in FIGS. 3A, 3B, and 3C. Perforations 74, 76 may also be located in the head rest 29 itself similar to perforations 51 in housing 24 shown in FIG. 3C. Also, speaker covers 70, 72 may include some form of sound attenuation device, for example, as shown in FIGS. 7A and 7B. Though not illustrated in FIGS. 4A and 4B, speakers 44 may also be located in the housing adjacent to head rest 29, for example, to the sides of head rest 29 or below head rest 29.

The inventions described with respect to FIGS. 1, 2A, 2B, 3A, 3B, 3C, 4A, and 4B clearly overcome the limitations of the prior art. For example, by positioning electric or non-electric speakers in the housing or head rest of a spa, without the need for special mounting extensions, the nominal height of the spa housing is not increased. As a result, the present invention has little or no negative impact upon the fabrication of the housing because the present invention does not require undesirable housing modifications. In addition, the speakers of the present invention can be inserted into a housing or head rest of an existing spa with little or no modification to the housing. When the speakers are incorporated in the head rest, the head rest mounting is unchanged, only openings for the conduits or wires need be provided (and typically these openings will be covered by the head rest assembly). When speakers according to the present invention are provided to the housing of an existing spa, only a simple orifice opening need be provided. In addition, the present invention does not affect the shipping requirements of new or modified spas since the spa housing dimensions are not increased when using the present invention.

Though the invention described above discloses the transmission of sound waves or electronic audio signals via wave guides or wires from remote speaker or electronic component, that is, speakers or components remote from speakers 42, 44, the present invention also includes the positioning of the electronic speaker or sound producing component in the vicinity of the speakers 42, 44. For example, according to one aspect of the present invention, an electronic speaker may be located directly beneath or adjacent to speakers 42, 44 or, for example, positioned within the head rest 29 and emit audio sound waves that are transmitted by wave guides 58, 60 or wires and still be within the scope of the present invention.

Figure 5A:
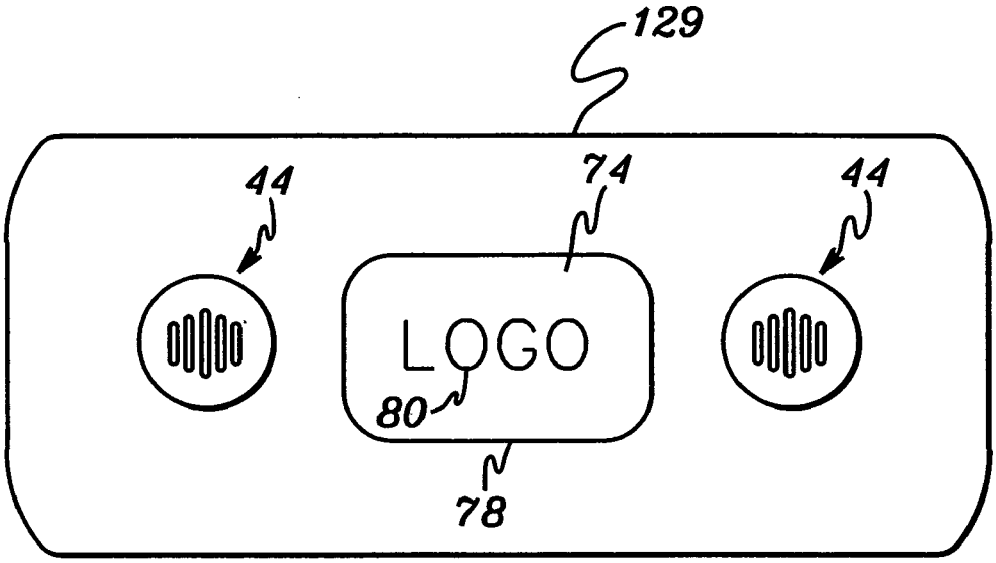
FIGS. 5A and 5B illustrate a top view and a cross-sectional view, respectfully, of a further aspect of the present invention.
Figure 5B:
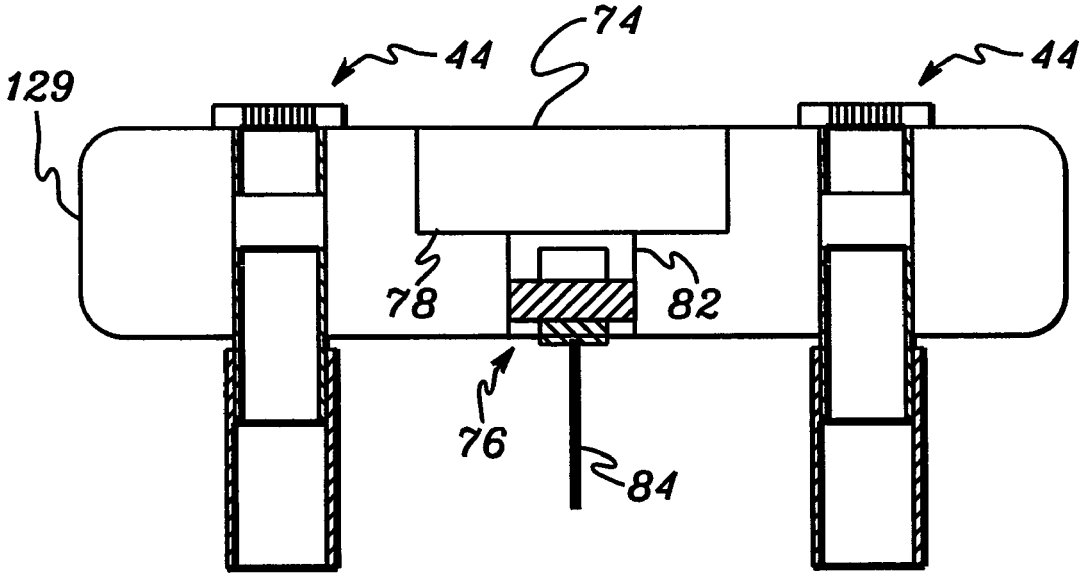

A further embodiment of this invention is illustrated in FIGS. 5A and 5B. FIGS. 5A and 5B illustrate a head rest 129 which is a modification to head rest 29 shown in FIGS. 4A and 4B. In addition to the speakers 44 shown mounted in head rest 29 of FIGS. 4A and 4B, FIGS. 5A and 5B show head rest 129 with the addition of a light-transferring insert 74 and light source 76. That is, all of the features included in the head rest 29 embodiment of FIGS. 4A and 4B are included in the head rest 129 of FIGS. 5A and 5B plus insert 74 and light source 76. Insert 74 may be one or more inserts located anywhere on the head rest 129 where illumination is desired. This aspect of the invention also includes a head rest 129 having only one or more inserts 74 and one or more light source 76 without speakers 44 and the related speaker components.

The light-transferring insert 74 is inserted into cavity 78 in head rest 129. Though insert 74 is shown rectangular in shape in FIGS. 5A and 5B, insert 74 may take any desirable shape, including circular, triangular, and oval, among others. A graphic design, logo, or other human readable indicia 80 may be located on, in, or behind the insert 74. Insert 74 may be transparent or translucent, for example, it may be clear or contain a shade of color. The insert 74 is also preferably resilient, or have the proper durometer, whereby the insert 74 will comfortably support the head of the bather or occupant of the spa. Materials that may be used for insert 74 include resilient silicon-based materials, for example, a resilient silicon-based material sold under the name Kryton by Dupont, or thermoplastic rubber (TPR) materials, though other suitable materials may be used. The insert 74 may be coplanar with the surface of head rest 129 or may extend beyond the surface of head rest 74 to ensure that the head of the user comfortably contacts the surface of insert 74 and not the head rest 129. Of course, the insert 74 may also not extend to the surface of head rest 129 but provide a recessed surface relative to the surface of head rest 129.

According to this aspect of the present invention, the one or more light-transferring inserts 74 may be illuminated by one or more light sources 76 mounted in head rest 129. Though the light source 76 is shown mounted below insert 74 in a cavity 82, light source 76 may be mounted in any location in head rest 129 as long as light is directed to and illuminates insert 74. The light source 76 may be any conventional light source, such as an incandescent or fluorescent light, a light-emitting diode (LED), or fiber optics. One preferred light source is an LED-type light source having embedded hardware and software that provides for a plurality of colors and visual effects. One such light source is an LED-type bulb manufactured by Color Kinetics of Boston, Mass. or Oryan of Vancouver Wash. Electrical power is typically provided to light source 76 via wire or cable 84. Control signals for controlling the operation of light source 76 may also be provided to light source 76 via cable 84. According to the present invention one or more light sources 76 may be used to illuminate one or more light-transferring inserts in head rest 129. In addition, the entire head rest 129 may be comprised of a light-transferring material, for example, silicon-based Kryton, and the entire head rest 129 may be illuminated by one or more light sources 76.

Figure 6A:
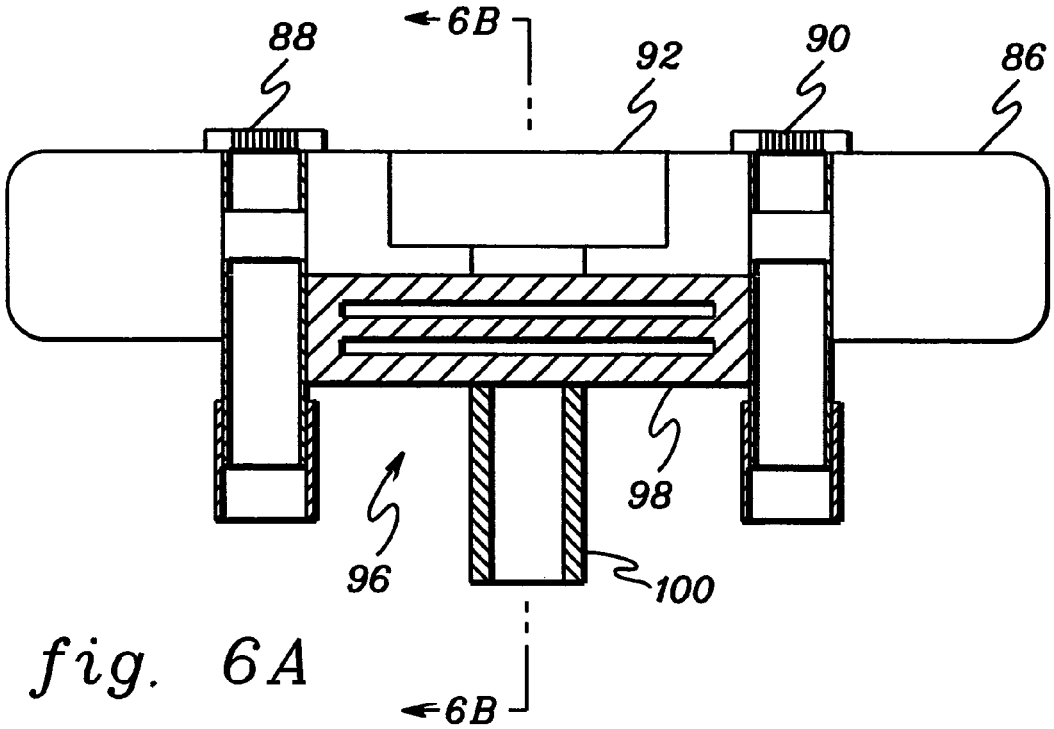
FIGS. 6A and 6B illustrate a top view and a cross-sectional view, respectfully, of still another aspect of the present invention.
Figure 6B:
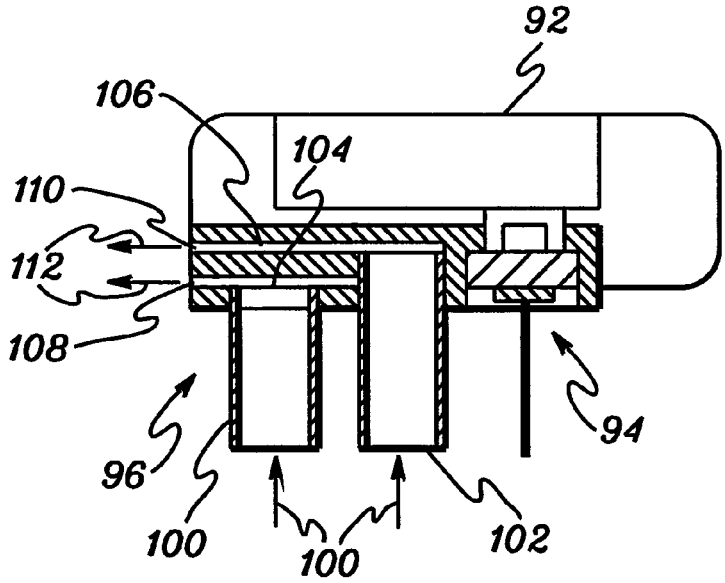

An even further aspect of a head rest 86 for a spa, tub, pool, bath, or shower according to the present invention is illustrated in FIGS. 6A and 6B. FIG. 6A illustrates a cross-sectional view of head rest 86 similar to the views in FIGS. 4B and 5B. FIG. 6B is a cross-sectional view as viewed along lines 6B-6B of FIG. 6A. The head rest shown in FIGS. 6A and 6B includes speakers 88, 90, similar to speakers 44 of FIGS. 4A and 4B; light-transferring insert 92 and light source 94, similar to insert 74 and light source 76 of FIGS. 5A and 5B; and also, according to this embodiment, includes a fluid-flow device 96. Though any fluid-flow device may be used according to the invention, a preferred device is one of the type marketed under the name Coplanar Flow Ejector (CFE) by Saratoga Spa & Bath of Latham, N.Y. and described in U.S. Pat. No. 6,182,303 B1 (the disclosure of which is incorporated by reference herein in its entirety).

The speakers 88, 90, insert 92, and light source 94 are similar in function and appearance as to what was described earlier. The invention shown in FIGS. 6A and 6B combines these features with the fluid-flow device 96 to provide a head rest 86 for a spa, tub, pool, bath, or shower which combines all these functions into a single device.

Fluid-flow device 96 includes a housing 98 and one or more water inlets 100, 102. These inlets receive a flow of pressurized fluid (typically water) as indicated by arrows 101, via conduits (not shown). The fluid is typically pressurized, for example, by means of at least one pump (not shown). The fluid is introduced through inlets 100, 102 and is passed to internal cavities 104, 106, respectively, and then is discharged via outlets 108, 110, respectively, as shown by arrows 112. In mounting the fluid-flow device 96 below the head rest 86 as shown, the head rest 86 provides all the amenities of speakers 88, 90; insert 92; and light source 94 while providing an apparatus in which a gentle flow of water is directed against the neck, shoulders, and back of the bather.

Light source 94 may be any conventional light source as described above with respect to light source 76. In one aspect of the invention, one or more light sources 94 illuminate one or more light-transferring inserts 92. However, a light source similar to light source 94 may also be used to illuminate the fluid-flow device 96. For example, the fluid-flow device 96, or any part of the fluid-flow device 96, may also be fabricated from a light-transferring material, for example, PTED polycarbonate or its equivalent. In one particular aspect of the invention, one or more light sources 94 are positioned adjacent to or mounted within fluid-flow device 96 whereby the fluid, typically water, discharged from outlet 108 or 110, or both is illuminated. This can be effected by locating one or more light sources 94 adjacent to the outlets 108, 110 to illuminate one or more of the outlets directly. The fluid flowing out of outlets 108, 110 may also be illuminated by one or more light sources 94 positioned adjacent to one or more light-transferable portions of fluid-flow device 96 whereby the one or more light sources 94 illuminate the fluid via the one or more light-transferable portions. The light-transferable portions may be transparent, or translucent, and may be color shaded to enhance the visual appearance of the water discharged.

FIGS. 7A and 7B illustrate a sound attenuation device 120 that can be used for the perforated cover of speaker 42 in FIGS. 3A and 3B; speakers 44 in FIGS. 4A, 4B, 5A, and 5B; or speakers 88, 89 in FIG. 6A. FIG. 7A illustrates a top view of device 120 and FIG. 7B illustrates a cross-sectional view viewed from the direction of lines 7B-7B in FIG. 7A. Device 120 includes a perforated cover 122 having perforations 124, similar to perforated covers 54, 70 and 72 of FIGS. 3A, 3B, 4A, and 4B. As described above, the perforations 124 may take any appropriate size, shape, or number.

According to this aspect of the invention, device 120 includes a perforated wheel 126 having perforations 128. Perforated wheel 126 is rotatably mounted on a pin 129 either above or below cover 122 and the perforations 128 are similar or identical in shape to perforations 124 in cover 122. The rotation of wheel 126 is effected by manually turning wheel 126 by means of tab 130. Cover 122 is mounted on conduit 132 and wheel 126 is mounted on pin 129 whereby the wheel 126 is rotatable relative to cover 122. Conduit 132 may be threaded or have external ribs on its outside diameter whereby device 120 can be inserted into, for example, spa housing 24 of FIG. 3B or head rest 29 of FIG. 4B.

According to this aspect of the invention, the sound waves passing through perforations 124 in cover 122 can be attenuated, that is, the volume reduced, by rotating wheel 126 via tab 130 whereby the perforations in cover 122 are at least partially obstructed by the unperforated portions of wheel 126. In one extreme, the perforations 124 are completely obstructed and little or no sound is transmitted through perforations 128. In the opposite extreme, the perforations 128 coincide with the perforations 124 and little or no obstruction of perforations 128 occurs, that is, a relative maximum volume of sound is produced.

FIG. 8 illustrates an isometric view of another embodiment of the present invention. FIG. 8 illustrates the relative contoured shape of a typical head rest 229, which can be used for head rests 29 and 129 discussed above. Again, head rest 229 is typically made of a flexible material that provides for at least some cushioning of the head of the occupant. Head rest 229 also includes at least one, typically two, electronic or wave-guide-type speakers 244 as discussed previously. A section of head rest 229 has also been removed in FIG. 8 to illustrate the relative location of flow element 298, for example, a CFE flow element.

Figure 9:
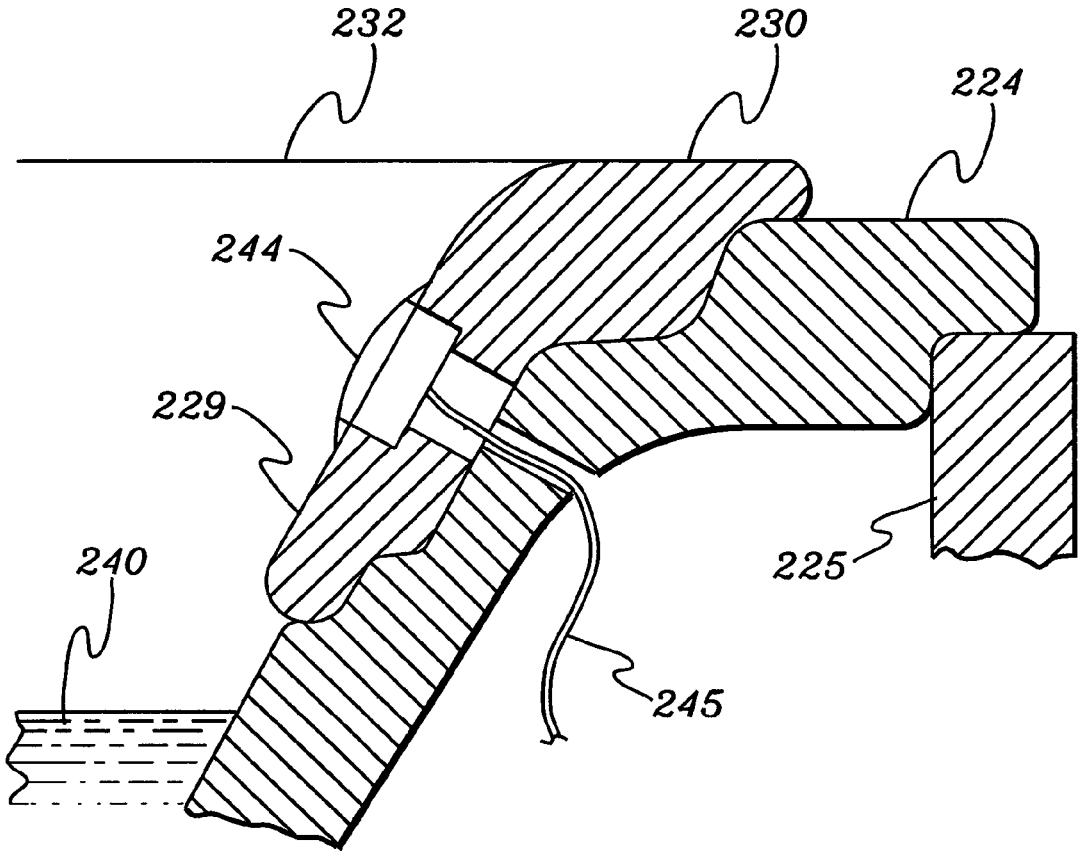
FIG. 9 is a cross sectional view of another aspect of the invention as mounted in a spa housing.

FIG. 9 illustrates a cross-sectional view of head rest 229 as typically mounted in housing 224. FIG. 9 illustrates a section as viewed through one of the speakers 244 of FIG. 8. Housing 224 is mounted on a support structure 225, which is typically a wooden structure with decorative wooden fascia. The speaker 244 in this aspect can be an electronic speaker or a wave-guide-type speaker as discussed above, but in FIG. 9 speaker 244 is shown as an electronic speaker which receives an electrical signal via wire 245, for example, from electronic component 30 (see FIG. 2A). The relative elevation of the water in housing 224 is illustrated by line 240.

In this aspect of the invention, the head rest 229 includes an upper extremity defined by an upper surface 230. This upper surface 230 defines an elevation 232. As clearly shown in FIG. 9, speakers 244 according to this aspect, are below the elevation 232. In a related aspect of the invention, speakers 244 can be mounted in housing 224 adjacent to or below head rest 229, for example, to the sides or below head rest 229, while mounted below elevation 232. Speakers 244 may also be mounted above water level 240. By mounting speakers 244 below elevation 232 according to this aspect of the invention, no housing extensions need be made to housing 224 which can negatively impact the manufacture, storage and shipping of the spa compared to the prior art.

Figure 10:
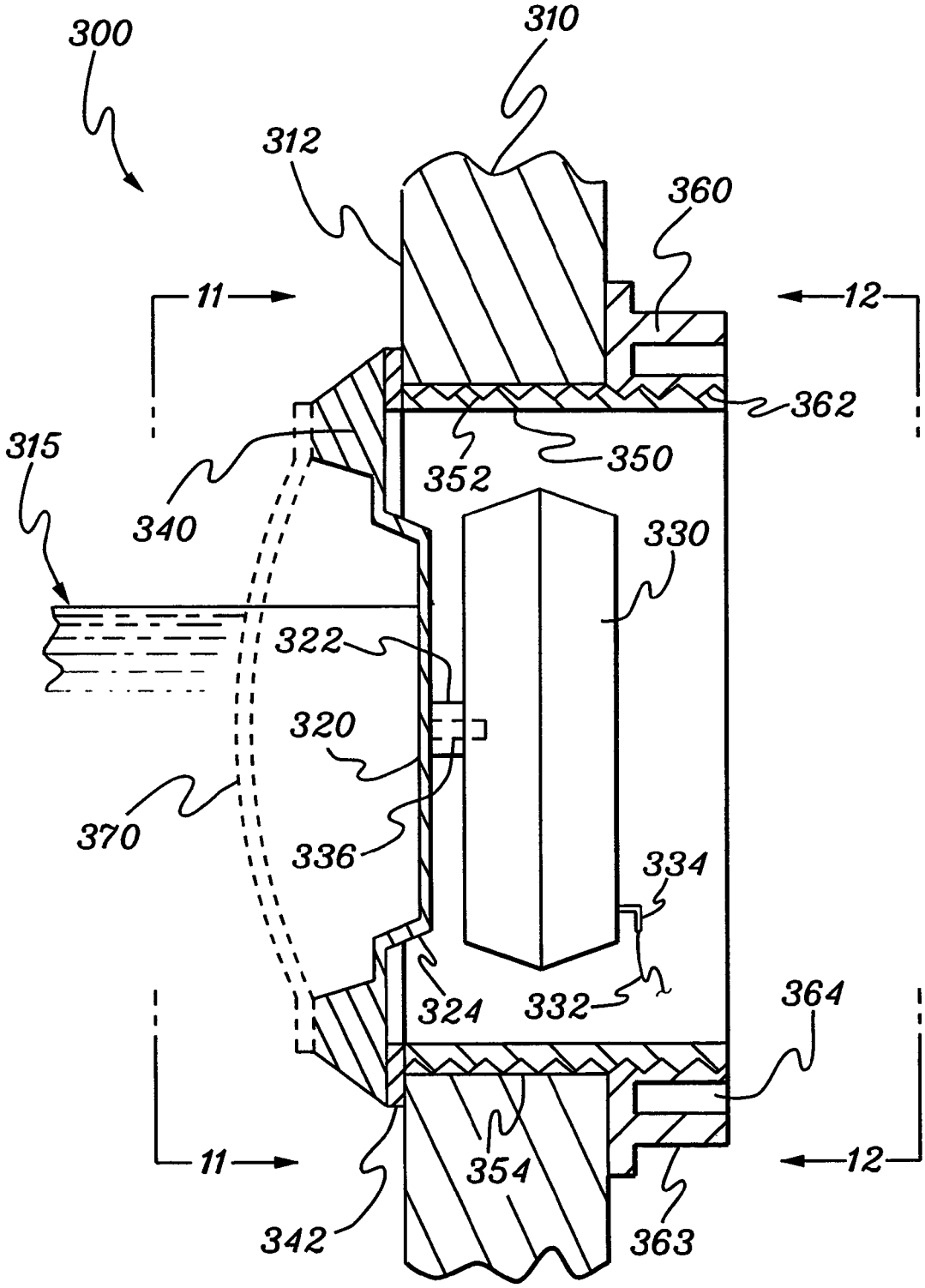
FIG. 10 is a cross sectional view of still another aspect of the invention as mounted in a spa housing.
Figure 11:
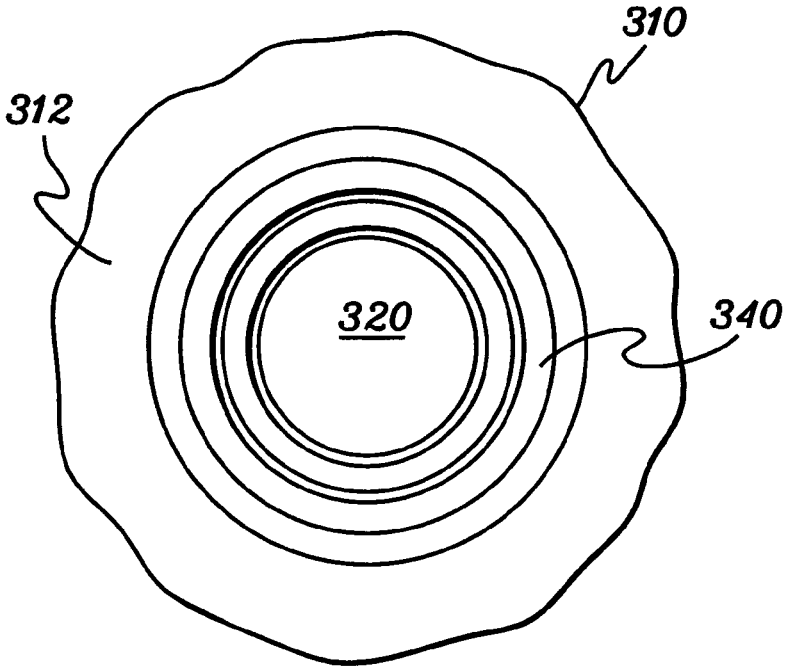
FIG. 11 is a front elevation view of the aspect of the invention shown in FIG. 10 taken along the lines 11-11 in FIG. 10.
Figure 12:
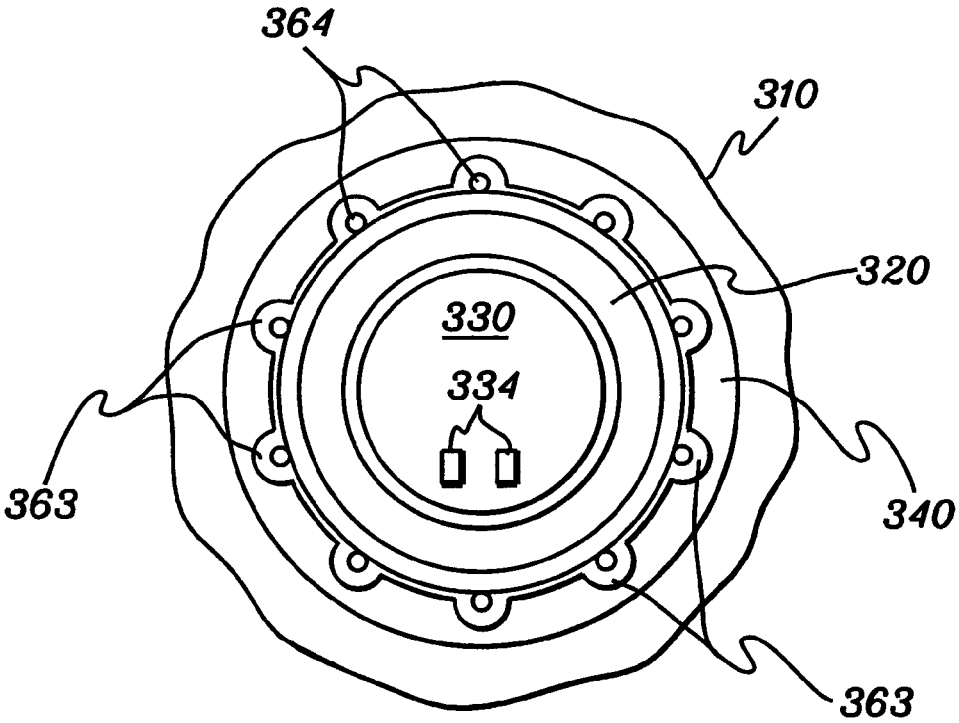
FIG. 12 is a rear elevation view of the aspect of the invention shown in FIG. 10 taken along the lines 12-12 in FIG. 10.

FIGS. 10-12 illustrate another aspect of the invention. FIG. 10 illustrates a cross-sectional view of audio speaker assembly 300 according to another aspect of the present invention. FIG. 11 is a front elevation view of speaker assembly 300 shown in FIG. 10 as viewed along section lines 11-11 in FIG. 10. FIG. 12 is a rear elevation view of speaker assembly 300 shown in FIG. 10 as viewed along section lines 12-12 in FIG. 10. Speaker assembly 300 may be mounted in a wall of a housing 310 of a spa, shower, pool, or related structure as described above. Though speaker assembly 300 is shown mounted in a vertical wall portion 312 of housing 310, speaker assembly 300 may be mounted in any wall portion of a spa, shower, pool, etc. including in an inclined wall portion or a horizontal wall portion, for example, the horizontal bottom portion of a spa or tub.

According to this aspect of the invention, speaker assembly 300 includes at least one diaphragm 320 mounted in wall portion 312 and at least one audio transducer 330 mounted to diaphragm 320. Audio transducer 330 may be any type of audio transducer that can transit an audio signal to diaphragm 320 whereby sound can be heard by the occupant of the spa. In one aspect of the invention, audio transducer 330 comprises an audio transducer marketed under the name Rolen Star audio transducer by Richtech Enterprises of Stockton, Calif. In one aspect of the invention, the Rolen Star-type audio transducer used for the present invention has a frequency range of about 20 Hz to about 20,000 Hz at about +/−3 decibels; an impedance of about 8 ohms; a maximum power of about 30 Watts; a diameter of about 4 inches; a thickness of about 1.75 inches; and a weight of about 2 pounds.

As shown in FIG. 10, audio transducer 330 may be powered by one or more wires 332 connected to electrical connectors 334 mounted on audio transducer 330.

Diaphragm 320 may be any membrane or surface to which audio transducer 330 may be mounted and which can transmit an audible sound signal generated by audio transducer 330. Diaphragm 320 may have a thickness that may range from about 0.0625 inches to about 2 inches, but typically may have a thickness between about 0.093 inches and about 0.50 inches, for example, about 0.109 inches. Diaphragm 320 may be planar with surface 312, may protrude beyond surface 312, or be recessed below surface 312, as shown in FIG. 10. In one aspect of the invention shown in FIG. 10, diaphragm 320 may be recessed in housing 310 by means of one or more beveled transitions 324. Diaphragm 320 may be parallel to surface 312 or oriented at an angle relative to surface 312, for example, diaphragm 320 may be canted to direct sound in the general direction of the ear of a bather in the spa. Diaphragm 320 may be metallic or non-metallic, but is preferably non-metallic to be more compatible with the moist and corrosive environment to which diaphragm 320 may be exposed. Diaphragm 320 may be made of plastic, for example, a PVC, an acrylonitrile butadiene styrene (ABS), or an acrylic. Diaphragm 320 may take any geometric shape including, circular, oval, square, rectangular, rectangular, and the like.

According to one aspect of the invention, diaphragm 320 may be mounted directly to surface 312 of housing 310. In another aspect of the invention, diaphragm 320 may be mounted in a housing that is mounted in housing 310. As shown in FIG. 10, according to one aspect of the invention, diaphragm 320 may be mounted to housing 310 by means of a mounting ring 340 which may be mounted to housing 310. Mounting ring 340 may be a metallic or non-metallic ring, for example, mounting ring 340 may be made from an ABS, a PVC, or their equivalents. Mounting ring 340 and diaphragm 320 may be individual parts, for example, individual parts mounted to each other by conventional fasteners or adhesives, or mounting ring 340 and diaphragm 320 may form an integral construction, for example, formed from the same material, such as, molded from the same plastic material or pressed from sheet metal. Mounting ring 340 having diaphragm 320 may be mounted to housing 310 by conventional means for example, by means of mechanical fasteners or adhesives.

According to one aspect of the invention, housing 310 includes water having a water level 315. Water level 315 may be above or below the level of speaker 300 or anywhere in between. According to the present invention, unlike conventional audio speakers, speaker 300 may be mounted in housing 310 and provide a source of sound, for example, music, to a bather occupying the spa without the water interfering with the transmission of sound or damaging the speaker or exposing the bather to the potential for electrical shock. According to one aspect of the invention, speaker 300 is mounted in housing 310 wherein leakage of water from housing 310 is minimized or avoided entirely. In one aspect of the invention, a gasket 342 may be inserted between mounting ring 340 and surface 312 of housing 310 to minimize leakage of liquids around mounting ring 340. Gasket 342 may be a circular gasket, for instance, a circular rubber gasket, for example, a Kryton gasket or its equivalent.

In another aspect of the invention, as shown in FIG. 10, mounting ring 340 may be mounted on a conduit 350 which extends through housing 310. Conduit 350 may provide a cavity for mounting audio transducer 330. Conduit 350 may be metallic or non-metallic, for example, conduit 350 may comprise PVC plastic pipe, ABS pipe, or their equivalent. As shown in FIG. 10, the outside diameter of conduit 350 may be threaded wherein conduit 350 provides a means for mounting diaphragm 320 in housing 310. Conduit 350 may have an external screw thread 352 may be attached to housing 310 by engaging the external screw thread 352 with a through hole 354 in housing 310 or with a complementary internal screw thread (no shown) in housing 310. In another aspect of the invention, as shown in FIG. 10, conduit 350 may be retained in housing 310 by means of retaining ring 360. As shown in FIG. 10 retaining ring 360 may be a threaded retaining ring, that engages the external thread 352 of conduit 350; however, retaining ring 360 may also engage conduit 350 by other conventional means, for example, by means of mechanical fasteners, an adhesive, or a snap-on or interlocking plastic construction. Retaining ring 360 may be metallic or non-metallic. In one aspect of the invention, retaining ring 360 is made of plastic, for example, a PVC, an ABS, or their equivalent. In one aspect of the invention, retaining ring 360 may have an internal screw thread 362 which engages external screw thread 352 of conduit 350 and retains conduit 350, mounting ring 340, diaphragm 320, and audio transducer 330 in housing 310. As shown in FIG. 12, retaining ring 360 may include two or more bosses 363 having blind holes 364 to facilitate handling and rotating of retaining ring 360, for example, manual rotation of retaining ring 360.

Speaker assembly 300 may also include a speaker cover 370, for example, shown in phantom in FIG. 10. Speaker cover 370 may protect diaphragm 320 from damage or simply provide an esthetically pleasing appearance to speaker assembly 300. Speaker cover 370 may be perforated or unperforated and may be provided in any desired geometric shape, for example, to match the geometric shape of diaphragm 320 defined above. Speaker cover 370 may be mounted to diaphragm 320, mounting ring 340, or wall portion 312 by means of mechanical fasteners, adhesives, or interlocking plastic connectors.

Audio transducer 330 may be mounted to diaphragm 320 by any conventional means. In one aspect of the invention, audio transducer 330 is mounted to diaphragm 320 by means of a threaded metal stud 336 threaded into a mounting boss 322 on the back of diaphragm 320. In another aspect of the invention, audio transducer 330 may be mounted to an intermediate diaphragm (not shown) which itself is mounted to diaphragm 320. For example, in one aspect of the invention, audio transducer 330 may be mounted to a thin plastic disk. The thin plastic disk, for example, a disk between about 0.0625 to about 0.25 inches thick, may function as an intermediate diaphragm and the thin plastic disk may be mounted to diaphragm 320, for example, by means of an adhesive or conventional mechanical fasteners, for example, by means of a mounting stud similar to stud 336.

As will be appreciated by those skilled in the art, features, characteristics, and/or advantages of the systems, devices, head rests, speakers, tubs, spas, showers, and/or fluid-flow devices described herein, may be applied and/or extended to any embodiment (e.g., and/or portion thereof).

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the following claims.

What is claimed is:

1. A sound system for a spa, the spa comprising a housing having an upper rim of substantially uniform elevation, the sound system comprising:

a head rest mounted on or below the upper rim so as not to substantially alter the substantially uniform elevation and adapted to support the head of an occupant of the spa, the head rest having at least one sound emitting perforation;

at least one electronic speaker located below the upper rim of the housing, the at least one electronic speaker positioned to transmit sound through the at least one sound emitting perforation and having a speaker wire extending within the housing; and a source of sound positioned within the housing and distal the at least one speaker for providing an audio signal to the at least one electronic speaker.

2. The sound system as recited in claim 1, wherein the at least one sound emitting perforation comprises a plurality of perforations.

3. The sound system as recited in claim 2, wherein the plurality of perforations comprises at least two sets of perforations.

4. The sound system as recited in claim 1, wherein the headrest comprises a resilient material.

5. The sound system as recited in claim 1, further comprising at least one sound wave guide adapted to transmit sound waves from the at least one electronic speaker to the at least one sound emitting perforation in the head rest.

6. The sound system as recited in claim 1, wherein the at least one electronic speaker comprises at least one marine-grade audio speaker.

7. The sound system as recited in claim 1, wherein the at least one electronic speaker is located directly beneath the at least one sound emitting perforation.

8. The sound system as recited in claim 1, wherein the headrest is mounted to the spa housing wherein the substantially uniform elevation of the spa is unchanged.

9. The sound system as recited in claim 5, wherein the sound wave guide comprises one of a cavity and a chamber.

10. The sound system as recited in claim 9, wherein the sound wave guide comprises one of a cavity and a chamber in the spa housing.

11. The sound system as recited in claim 1, wherein the at least one speaker is positioned one of beneath and within the head rest.

12. The sound system as recited in claim 1, wherein the sound system does not negatively effect the shipping requirements of the spa.

13. The sound system as recited in claim 1, wherein the sound system does not increase dimensions of the spa.

* * * * *